US010683594B2

(12) United States Patent
Li et al.

(10) Patent No.: US 10,683,594 B2
(45) Date of Patent: Jun. 16, 2020

(54) THREE-DIMENSIONAL INTEGRATED SHOE BLANK WITH TONGUE AND METHOD FOR MANUFACTURING THE SAME

(71) Applicant: Wholeknit International Co., Ltd., Apia (WS)

(72) Inventors: Yu-Lin Li, Apia (WS); Yi-Hsing Dou, Apia (WS)

(73) Assignee: Wholeknit International Co., Ltd., Apia (WS)

( * ) Notice: Subject to any disclaimer, the term of this patent is extended or adjusted under 35 U.S.C. 154(b) by 269 days.

(21) Appl. No.: 15/806,176

(22) Filed: Nov. 7, 2017

(65) Prior Publication Data

US 2018/0343954 A1 Dec. 6, 2018

(30) Foreign Application Priority Data

Jun. 5, 2017 (TW) ..... 106118562 A

(51) Int. Cl.
*D04B 1/10* (2006.01)
*A43B 1/04* (2006.01)

(52) U.S. Cl.
CPC ..... *D04B 1/108* (2013.01); *A43B 1/04* (2013.01); *D04B 1/106* (2013.01); *D10B 2403/0332* (2013.01); *D10B 2501/043* (2013.01)

(58) Field of Classification Search
CPC ..... D04B 1/106; D04B 1/108; D04B 1/22; D04B 1/24; D04B 7/10; D04B 7/30; A43B 1/04
USPC ..... 66/70, 67, 76, 177, 186, 187
See application file for complete search history.

(56) References Cited

U.S. PATENT DOCUMENTS

| | | | | |
|---|---|---|---|---|
| 7,937,972 | B2 | 5/2011 | Busi | |
| 9,003,836 | B1 * | 4/2015 | Podhajny | A43B 23/024 66/69 |
| 9,771,673 | B2 * | 9/2017 | Ikenaka | A43B 1/04 |
| 9,920,461 | B2 | 3/2018 | Aristizabal et al. | |
| 2008/0110048 | A1 | 5/2008 | Dua et al. | |
| 2010/0154256 | A1 | 6/2010 | Dua | |

(Continued)

FOREIGN PATENT DOCUMENTS

| | | | |
|---|---|---|---|
| CN | 101583294 | A | 11/2009 |
| CN | 102271548 | A | 12/2011 |

(Continued)

*Primary Examiner* — Danny Worrell
(74) *Attorney, Agent, or Firm* — Innovation Capital Law Group, LLP; Vic Lin

(57) ABSTRACT

The present invention provides a method for knitting three-dimensional shoe blanks, comprising: knitting a heel and lateral portion; continuing knitting a rear sole portion; continuing knitting a front sole portion; continuing knitting a toe cap portion; and continuing knitting a tongue portion. When the knitting comes to the first connecting selvage edges at the two sides of the rear sole portion, the first connecting selvage edges can be knitted together with the lateral live stitches in the heel and lateral portion, so that the heel and lateral portion can be combined with the rear sole portion. Also, when the knitting comes to the second connecting selvage edges at the two sides of the toe cap portion, the second connecting selvage edges can be knitted together with the latitudinal live stitches in the front sole portion, so that the toe cap portion can be combined with the front sole portion.

12 Claims, 17 Drawing Sheets

(56) References Cited

U.S. PATENT DOCUMENTS

| | | | | |
|---|---|---|---|---|
| 2014/0237861 | A1* | 8/2014 | Podhajny | A43B 1/04 36/9 R |
| 2014/0245633 | A1* | 9/2014 | Podhajny | A43B 23/26 36/45 |
| 2016/0213097 | A1 | 7/2016 | Uchikawa et al. | |
| 2016/0219966 | A1 | 8/2016 | Podhajny et al. | |
| 2017/0119083 | A1* | 5/2017 | Podhajny | A43B 1/04 |
| 2018/0132558 | A1* | 5/2018 | Berrian | D04B 1/102 |
| 2018/0184755 | A1 | 7/2018 | Yumiba et al. | |
| 2018/0199668 | A1 | 7/2018 | Yumiba et al. | |
| 2018/0317593 | A1* | 11/2018 | Dealey | A43B 1/04 |
| 2018/0343954 | A1 | 12/2018 | Li et al. | |
| 2018/0343956 | A1 | 12/2018 | Li et al. | |
| 2018/0343973 | A1* | 12/2018 | Hancock | A43B 23/0215 |
| 2018/0343974 | A1 | 12/2018 | Hancock | |

FOREIGN PATENT DOCUMENTS

| | | | |
|---|---|---|---|
| JP | 2015014058 | A | 1/2015 |
| TW | 201633943 | A | 10/2016 |

* cited by examiner

THREE-DIMENSIONAL INTEGRATED SHOE BLANK WITH TONGUE AND METHOD FOR MANUFACTURING THE SAME

PRIORITY

The present invention claims priority to the application Ser. No. 10/611,8562 filed on Jun. 5, 2017 in Taiwan (ROC), which was entitled "THREE-DIMENSIONAL INTEGRATED SHOE BLANK WITH TONGUE AND METHOD FOR MANUFACTURING THE SAME". All of which are hereby incorporated by reference as if fully set forth herein.

FIELD OF INVENTION

This invention generally relates to a three-dimensional shoe blank with tongue and a method for manufacturing the same. Specifically, the present invention relates to a three-dimensional integrated knitted shoe blank with tongue and a method for manufacturing the same.

BACKGROUND

In the conventional shoe-making process, a shoe is made by connecting multiple pieces of shoe parts. Consequently, the materials and the process for manufacturing the shoes become very complicated. In recent years, owing to better permeability and comfort, less consumables required, and lower cost in the manufacturing process compared to conventional shoes, knitted shoes have quickly developed and gradually occupied a place in the market.

As mentioned above, generally, knitted shoes are made by knitting yarns to form a shoe blank using the knitting machine and further attaching the shoe blank to the shoe sole through processing. Here, the shapes of the shoe blanks formed by knitting are varied with the various types of knitting machines and knitting methods. Limited by the number of needle beds and current methods of knitting, two-needle-bed flat knitting machines commonly used in the industry generally knit and form a two-dimensional shoe blank in a sheet fabric form first, then the two-dimensional shoe blanks are further processed through seaming techniques to build a three-dimensional shape. However, due to the delicate and tedious seaming work required, it is hard to improve the production efficiency of the knitted shoes. In addition, two-dimensional shoe blanks usually only contain the part that covers the foot dorsal, resulting in lack of proper protection for the plantar, and such a two-dimensional shoe blank without the plantar part makes its conjugation and seaming with the shoe sole much more difficult. Accordingly, the level of difficulty in the conjugation and the seaming of two-dimensional shoe blanks in the sheet fabric form is further increased.

In view of the above-mentioned reasons, it is necessary to develop an integrated shoe blank with various three-dimensional structures, and the corresponding methods for manufacturing or knitting the integrated shoe blank with various three-dimensional structures.

SUMMARY OF THE INVENTION

Technical Means for Solving the Problems

To solve the above issues, an embodiment of the present invention provides a method for knitting three-dimensional shoe blanks by flat knitting machines. Said method comprises of providing at least one yarn to knit and form a heel and lateral portion; continuing knitting and forming a rear sole portion from a predetermined number of stitches along the center of the edge of the heel and lateral portion; continuing knitting and forming a front sole portion from the rear sole portion; continuing knitting and forming a toe cap portion from the front sole portion; and continuing knitting and forming a tongue portion from the toe cap portion. In the said method, after forming the heel and lateral portion, a plurality of lateral live stitches are preserved on the needle bed at the first pending selvage edges along the two sides of the end edge of the heel and lateral portion, thereby as the rear sole portion is formed, the two sides of the rear sole portion, i.e., the first connecting selvage edges, can be joined to the first pending selvage edges by having the flat knitting machine move transversely from side to side to sequentially knit the live stitches at the two sides of the rear sole portion together with the preserved lateral live stitches on the needle bed respectively, so that the heel and lateral portion can be combined with the rear sole portion to form a three-dimensional rear shoe part. Further, when knitting the front sole portion, the knitting is narrowed on both sides, and a plurality of latitudinal live stitches along the two sides of the front sole portion are preserved on the needle bed at the second pending selvage edges, thereby as the toe cap portion is knitted, the two sides of the toe cap portion, i.e., the second connecting selvage edges, can be joined to the second pending selvage edges by sequentially knitting the live stitches on the toe cap portion together with the corresponding latitudinal live stitches preserved on the needle bed to form a three-dimensional front shoe part in a bag shape.

Another embodiment of the present invention provides a three-dimensional shoe blank knitted by the flat knitting machine. The said three-dimensional shoe blank is an integrated fabric product comprising a heel and lateral portion, a rear sole portion extending from the central part of the heel and lateral portion, a front sole portion extending from the rear sole portion, a toe cap portion extending from a folding line at the top edge of the front sole portion, and a tongue portion extending from the toe cap portion. In the said three-dimensional shoe blank, the heel and lateral portion is respectively provided with the first pending selvage edges along the two sides thereof, the rear sole portion is respectively provided with the first connecting selvage edges along the two sides thereof, and the first connecting selvage edges are knitted together with the first pending selvage edges to form a three-dimensional rear shoe part having two knitted lines connecting the rear sole portion and the heel and lateral portion. In addition, in the said three-dimensional shoe blank, the front sole portion is respectively provided with the second pending selvage edges along the two sides thereof, the toe cap portion is respectively provided with the second connecting selvage edges along the two sides thereof, and the second connecting selvage edges are knitted together with the second pending selvage edges to connect the front sole portion and the toe cap portion and form a bag-shape structure accordingly.

Technical Effects Achieved by the Technical Means

Based on the three-dimensional shoe blank and the method for manufacturing the same in the embodiments of the present invention, an integrated fabric product can be knitted and formed without seaming. Thus, subsequent seaming work can be omitted, so as to simplify the manufacturing process of the shoe blank and increase the production efficiency. Furthermore, the three-dimensional integrated shoe blank also improves the integrity and appearance of the shoes.

DETAILED DESCRIPTION OF THE PRESENT INVENTION

Various embodiments will be described hereinafter, and those skilled in the art should readily understand the spirit and principle of the present invention with reference to the description in conjunction with the drawings. However, although certain embodiments are set forth in the text specifically, these embodiments are to be regarded as illustrative only and are not to be regarded as limiting or exhaustive in all respects. Therefore, it will be apparent for those skilled in the art to make various changes and modifications to the present invention without departing from the spirit and principles of the invention.

A method for knitting a three-dimensional integrated shoe blank according to an embodiment of the present invention will be described with reference to FIGS. 1 to 4 hereinafter.

Figure 1:
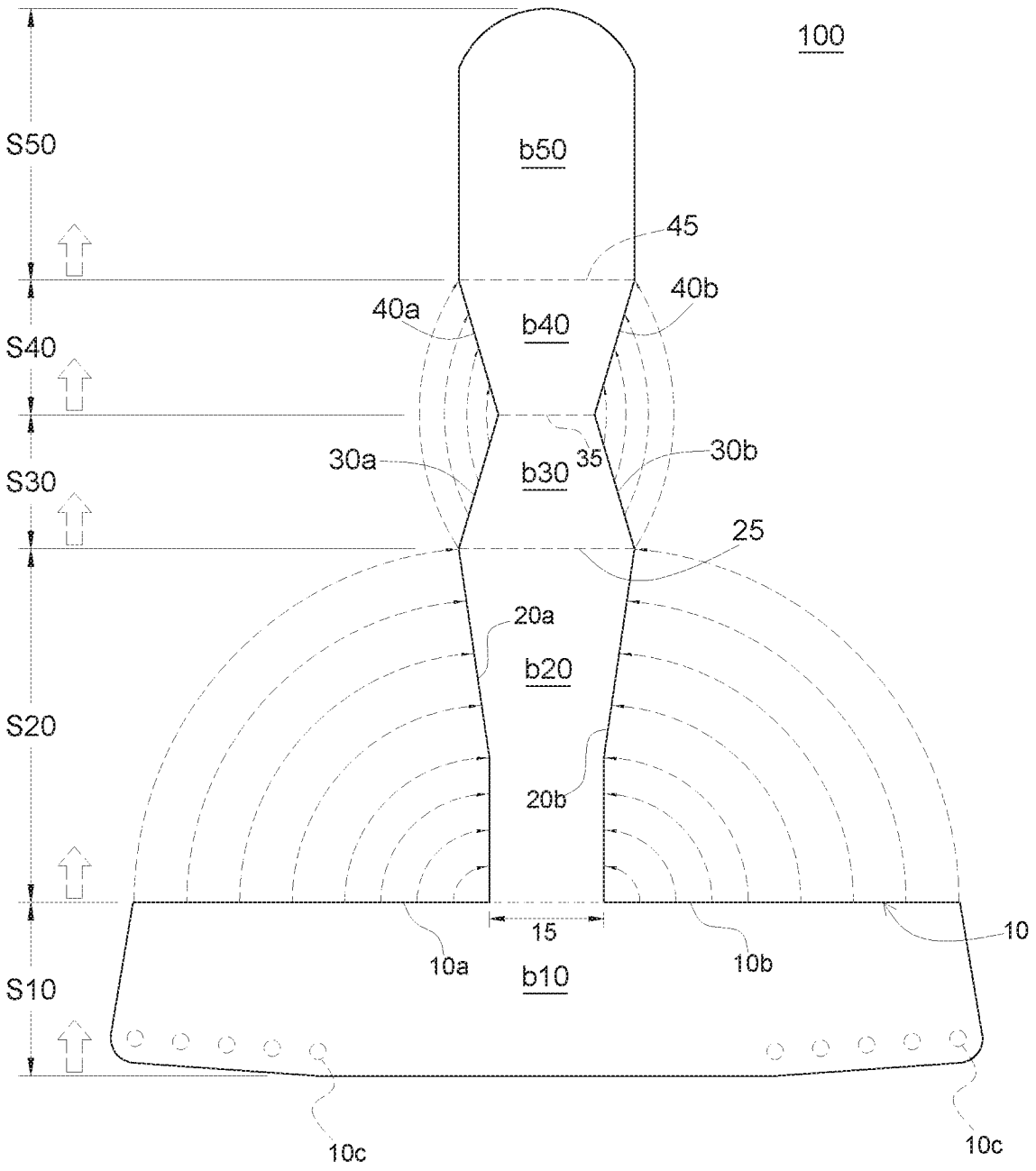
FIG. 1 is a schematic plan view of a three-dimensional shoe blank according to an embodiment of the present invention.

Referring to FIG. 1, in knitting the shoe blank 100, at least one yarn should be provided to sequentially knit and form a heel and lateral portion b10, a rear sole portion b20, a front sole portion b30, a toe cap portion b40 and a tongue portion b50.

In the said knitting process, the shoe blank 100 can be double knitted and formed on the front/rear needle bed by a two-needle-bed flat knitting machine, but it is not limited thereto. Further, at least a yarn stated herein is preferentially made and formed by twisting and combining multiple yarns with different characteristic (Such as materials, types, shapes, colors and so on), but it is not limited thereto. Moreover, when knitting different blocks or the same block, the knitting yarns used can be substituted based on the requirements.

As mentioned above, embodiments of the present invention will be illustrated by the example of double knitting on the front/rear needle bed using a two-needle-bed flat knitting machine. However, the invention may be made with different knitting devices or by manual knitting provided that they comply with the spirit of the present invention, and the invention is not limited thereto.

Figure 2A:
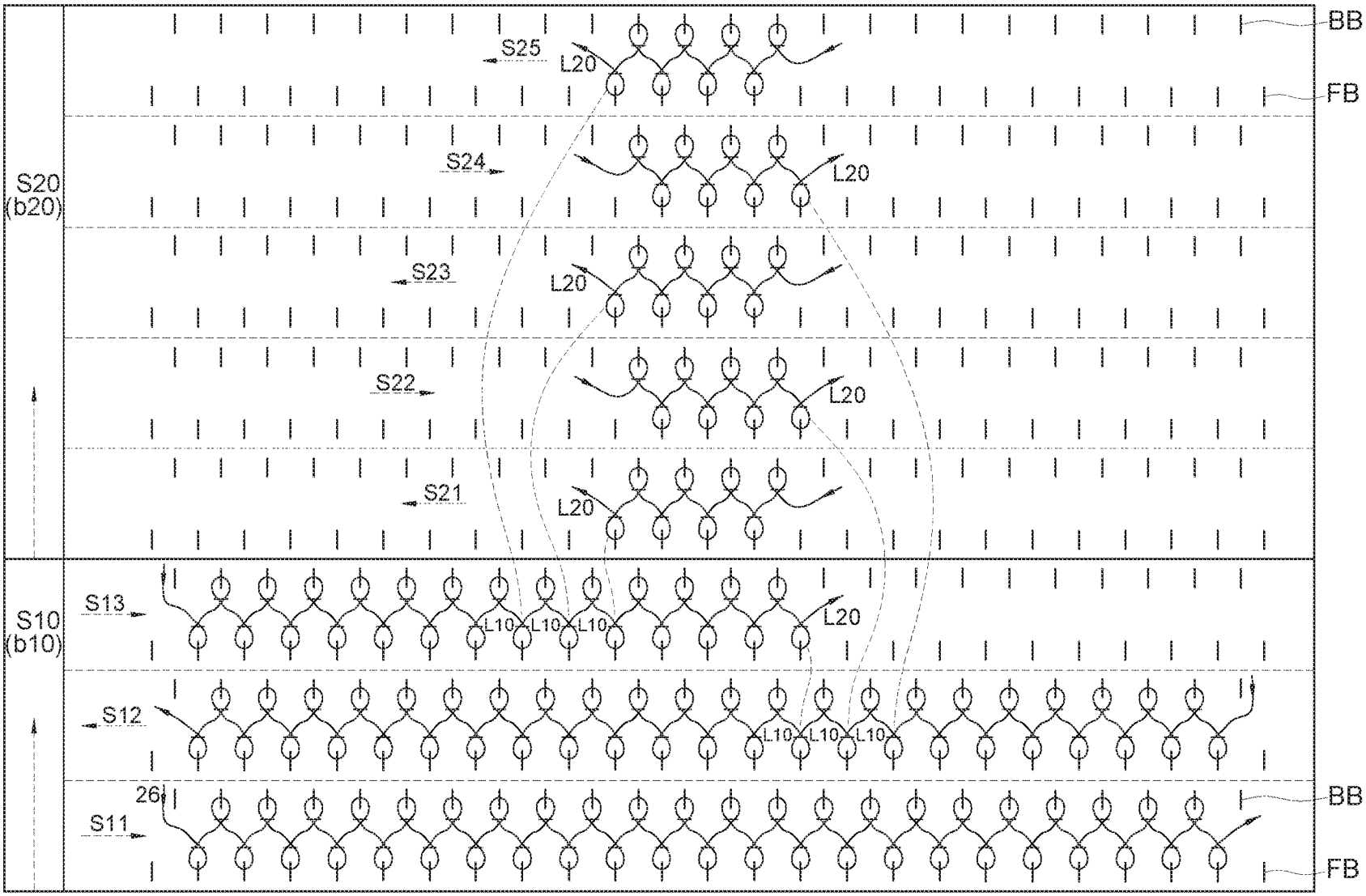
FIGS. 2A and 2B are schematic views of a knitting process of a three-dimensional shoe blank according to an embodiment of the present invention.

Specifically, referring to FIG. 2A in conjunction with FIG. 1, according to a manufacturing method of an embodiment of the present invention, at least a yarn 26 is provided to form the heel and lateral portion b10 by double knitting on the front needle bed FB and the rear needle bed BB. That is, in the step S10 for manufacturing the heel and lateral portion b10, the yarn 26 is first double knitted transversely from left to right in accordance with the direction indicated by the arrow S11 of FIG. 2A in a crosswise manner sequentially on the front needle bed FB and the rear needle bed BB on the flat knitting machine. Then, following the direction indicated by the arrow S12, the knitting is carried out transversely from right to left on the flat knitting machine. Here, in order to form the heel and lateral portion b10 with desired size, the steps indicated by the arrow S11 and arrow S12 may be optionally repeated multiple times. Finally, next to the step shown by the arrow S12, the knitting is carried out transversely from left to right in accordance with the direction indicated by the arrow S13 till the predetermined location on the flat knitting machine.

The above directions are only examples for convenience of illustration, and as long as the knitting is reciprocated, the actual knitting direction may be opposite to the above example and may include different numbers of knitting rows.

Referring to FIG. 1, in the manufacturing process of the heel and lateral portion b10, one or more shoe holes 10*c* may be knitted on both sides of the front edge of the heel and lateral portion b10, or one or more shoe holes 10*c* may be punched on both sides of the front edge with metal rings after the heel and lateral portion b10 is made, or one or more shoe holes 10*c* may be knitted and formed in a rough shape and then punched with metal rings to further enhance the shape of the shoe holes 10*c*. However, the present invention is not limited thereto, and the one or more shoe holes 10*c* can be formed on the heel and lateral portion b10 with various known or future developed techniques, and the location formed with the shoe holes 10*c* may be varied based on the design of the shoes.

In the aforesaid knitting method, as shown in FIG. 1 and FIG. 2A, after forming the heel and lateral portion b10, a plurality of lateral live stitches L10 are preserved on the front needle bed FB at the first pending selvage edges 10*a* and 10*b* along two sides of the end edge 10 of the heel and lateral portion b10. Specially, the rear sole portion b20 extends from a predetermined number of stitches along the center (that is, the central part 15 in FIG. 1) of the end edge 10 of the heel and lateral portion b10, thus a plurality of lateral live stitches L10 can be preserved respectively along the two sides of the end edge 10 of the heel and lateral portion b10.

As described above, after forming the heel and lateral portion b10 and preserving the plurality of lateral live stitches L10, in step S20, the rear sole portion b20 is knitted from a predetermined number of stitches along the center of the end edge 10 of the heel and lateral portion b10. Specifically, similar to the manner of knitting and forming the heel and lateral portion b10 in step 10, the rear sole portion b20 is formed by double knitting repeatedly and reciprocally in a crosswise manner from right to left/from left to right on the front needle bed FB and the rear needle bed BB multiple times on the flat knitting machine.

For example, the rear sole portion b20 may be double knitted and formed from a predetermined number of stitches along the center of the end edge 10 of the heel and lateral portion b10 (Such as the central part 15 in FIG. 1 or eight stitches in FIG. 2A) on the front needle bed FB and the rear needle bed BB, sequentially along the directions indicated by the arrows S21, S22, S23, S24, and S25. Here, similar to the heel and lateral portion b10 described above, the number of reciprocating repetitions of the double knitting for the rear sole portion b20 can be determined based on the required size to be formed.

In the aforesaid step for knitting the rear sole portion b20, when the number of stitches on the first connecting selvage edges 20*a* and 20*b* on the two sides reaches a predetermined number while knitting the rear sole portion b20, the rear needle bed BB can move transversely from side to side to sequentially knit the live stitches L20 at the edge of the rear sole portion b20 together with the lateral live stitches L10 on the front needle bed FB respectively. That is, when the knitting comes to the edge of the right side of the rear sole portion b20, the live stitches L20 at the edge of the right side of the rear sole portion b20 corresponds to the lateral live stitches L10 on the right side of the heel and lateral portion b10, so that the lateral live stitches L10 on the right side can be subsequently knitted. Conversely, when the knitting comes to the edge of the left side of the rear sole portion b20, the live stitches L20 at the edge of the left side of the rear sole portion b20 corresponds to the lateral live stitches L10 on the left side of the heel and lateral portion b10, so that the lateral live stitches L10 on the left side can be subsequently knitted.

Figure 3A:
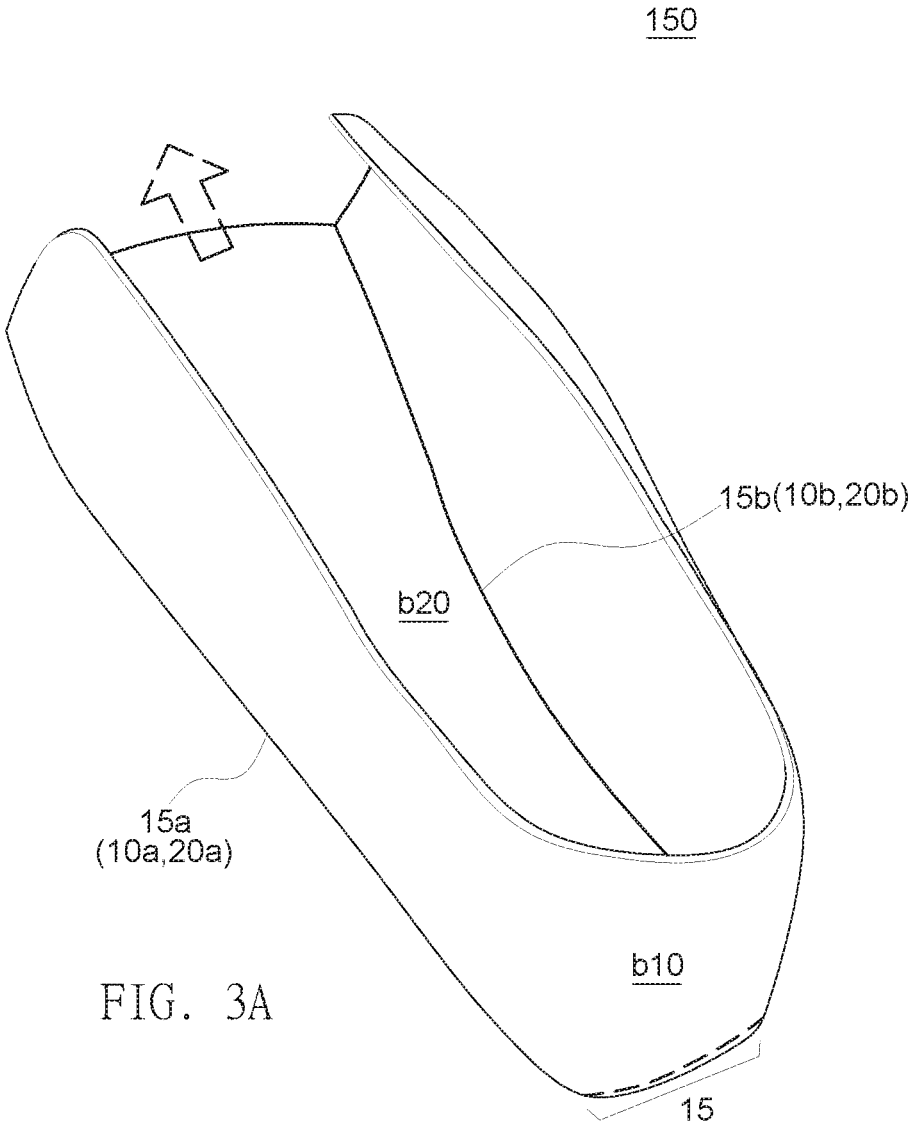
FIGS. 3A and 3B are schematic views of stereoscopic molding of a three-dimensional shoe blank in a knitting process according to an embodiment of the present invention.

Accordingly, as shown in FIG. 3A in conjunction with FIG. 1 and FIG. 2A, as the rear sole portion b20 is being knitted, the live stitches L20 at the edge of the left and right sides can be sequentially knitted together with the corresponding lateral live stitches L10. Therefore, along with the completion of the knitting of the rear sole portion b20, the joining of the rear sole portion b20 and the heel and lateral portion b10 is also completed simultaneously. Consequently, the rear sole portion b20 and the heel and lateral portion b10 can be connected along two knitted lines 15*a* and 15*b* so as to form a three-dimensional rear shoe part 150.

Next, similar to the step for forming the three-dimensional rear shoe part 150 described above, the step for forming the three-dimensional front shoe part 350 by knitting the front sole portion b30 and the toe cap portion b40 will then be illustrated with reference to FIG. 1, FIG. 2B and FIG. 3B hereinafter.

After finishing the three-dimensional rear shoe part 150 formed by knitting the rear sole portion b20 and the heel and lateral portion b10 together, the front sole portion b30 is formed by continue knitting from the rear sole portion b20 on the front/rear needle bed. Specifically, as shown in FIG. 1, the front sole portion b30 is subsequently knitted from the rear sole portion b20 at the boundary line 25 between the front sole portion b30 and the rear sole portion b20. Here, as shown in FIG. 2B, the front sole portion b30 can be knitted in a way of repeating the double knitting reciprocally in a crosswise manner from right to left/from left to right on the front needle bed FB and the rear needle bed BB multiple times on the flat knitting machine as stated above, sequentially along the directions indicated by the arrows S31, S32, S33, S34, S35, S36 and S37. Similar to the heel and lateral portion b10 stated above, the number of reciprocating repetitions of the double knitting for the front sole portion b30 can be determined based on the required size to be formed.

Figure 2B:
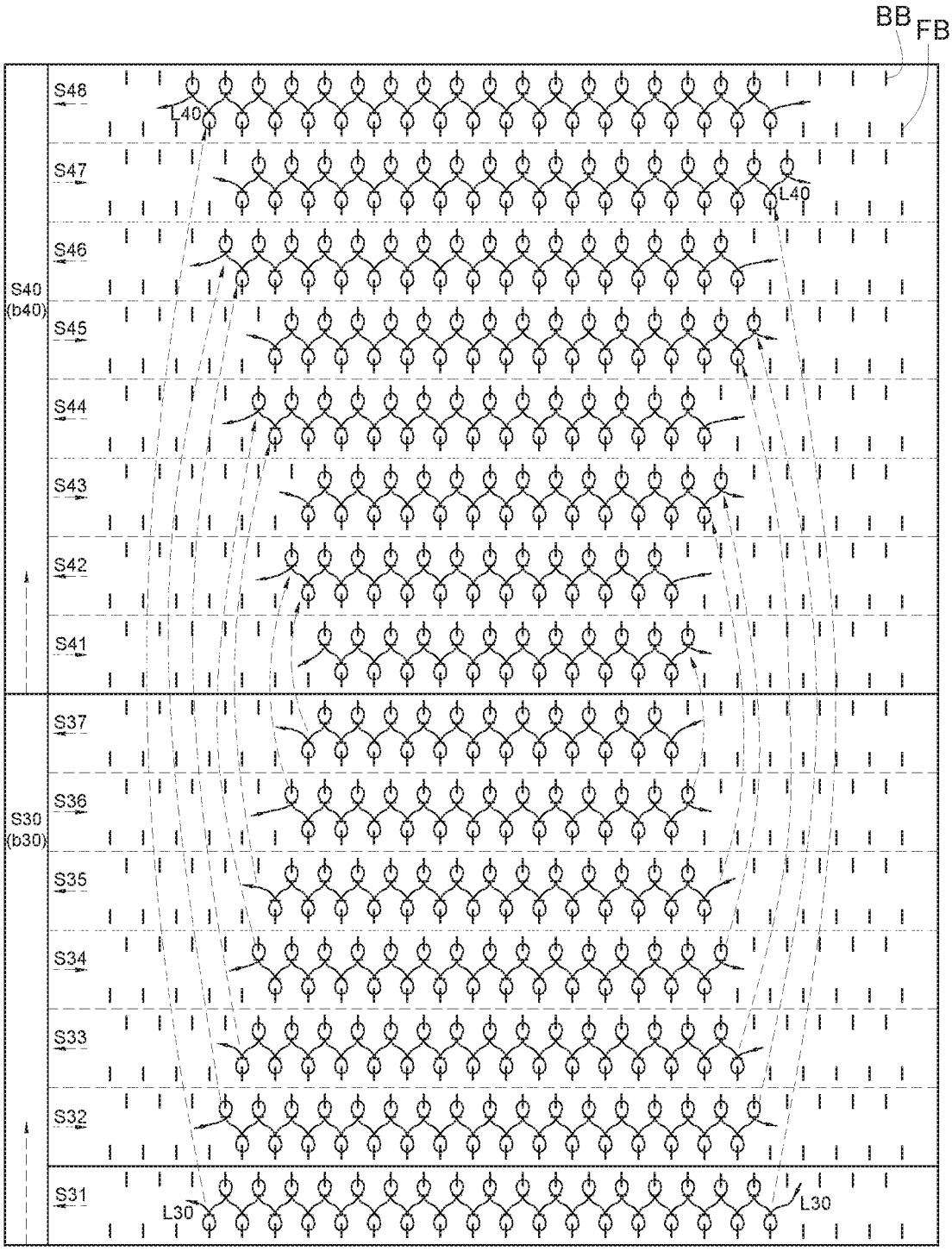

As shown in FIG. 2B and FIG. 1, in the step for knitting the front sole portion b30, the knitting is gradually and sequentially narrowed on the two sides of the front sole portion b30 from the width of the boundary line 25 so that the width of the front sole portion b30 is gradually reduced. Also, in the knitting step S30, when the knitting comes to the edge of the two sides of the front sole portion b30, a plurality of latitudinal live stitches L30 are preserved on the front/rear needle bed at the second pending selvage edges 30*a* and 30*b* along two sides of the front sole portion b30 respectively. Thus, after finishing the knitting of the front sole portion b30, a plurality of latitudinal live stitches L30 are respectively preserved at the second pending selvage edges 30*a* and 30*b*.

As mentioned above, after finishing the knitting of the front sole portion b30, the toe cap portion b40 is knitted and formed by continuing the width of the front sole portion b30 from the folding line 35 between the front sole portion b30 and the toe cap portion b40 on the front/rear needle bed. Here, the toe cap portion b40 can be knitted in a way of repeating the double knitting in a crosswise manner reciprocally from right to left/from left to right on the front needle bed FB and the rear needle bed BB multiple times on the flat knitting machine as stated above, sequentially along the directions indicated by the arrows S41, S42, S43, S44, S45, S46, S47, and S48. Similar to the heel and lateral portion b10 stated above, the number of reciprocating repetitions of the double knitting for the toe cap portion b40 can be determined based on the required size to be formed.

In the step S40 for knitting the toe cap portion b40, in contrast to the step S30, the knitting is gradually and sequentially widened at two sides of the toe cap portion b40 from the width of the folding line 35 so that the width of the toe cap portion b40 is gradually increased. Also, in the knitting step S40, when the knitting of the toe cap portion b40 reaches the edges at the two sides, the front/rear needle bed can move transversely from side to side to sequentially knit the live stitches L40 at the second connecting selvage edges 40*a* and 40*b* on the two sides of the toe cap portion b40 together with the latitudinal live stitches L30 on the front/rear needle bed respectively. That is, when the knitting comes to the edge of the right side of the toe cap portion b40, the live stitches L40 at the edge of the right side of the toe cap portion b40 corresponds to the latitudinal live stitches L30 on the right side of the front sole portion b30, so that the latitudinal live stitches L30 on the right side can be subsequently knitted. Conversely, when the knitting comes to the edge of the left side of the toe cap portion b40, the live stitches L40 at the edge of the left side of the toe cap portion b40 corresponds to the latitudinal live stitches L30 on the left side of the front sole portion b30, so that the latitudinal live stitches L30 on the left side can be subsequently knitted.

Figure 3B:
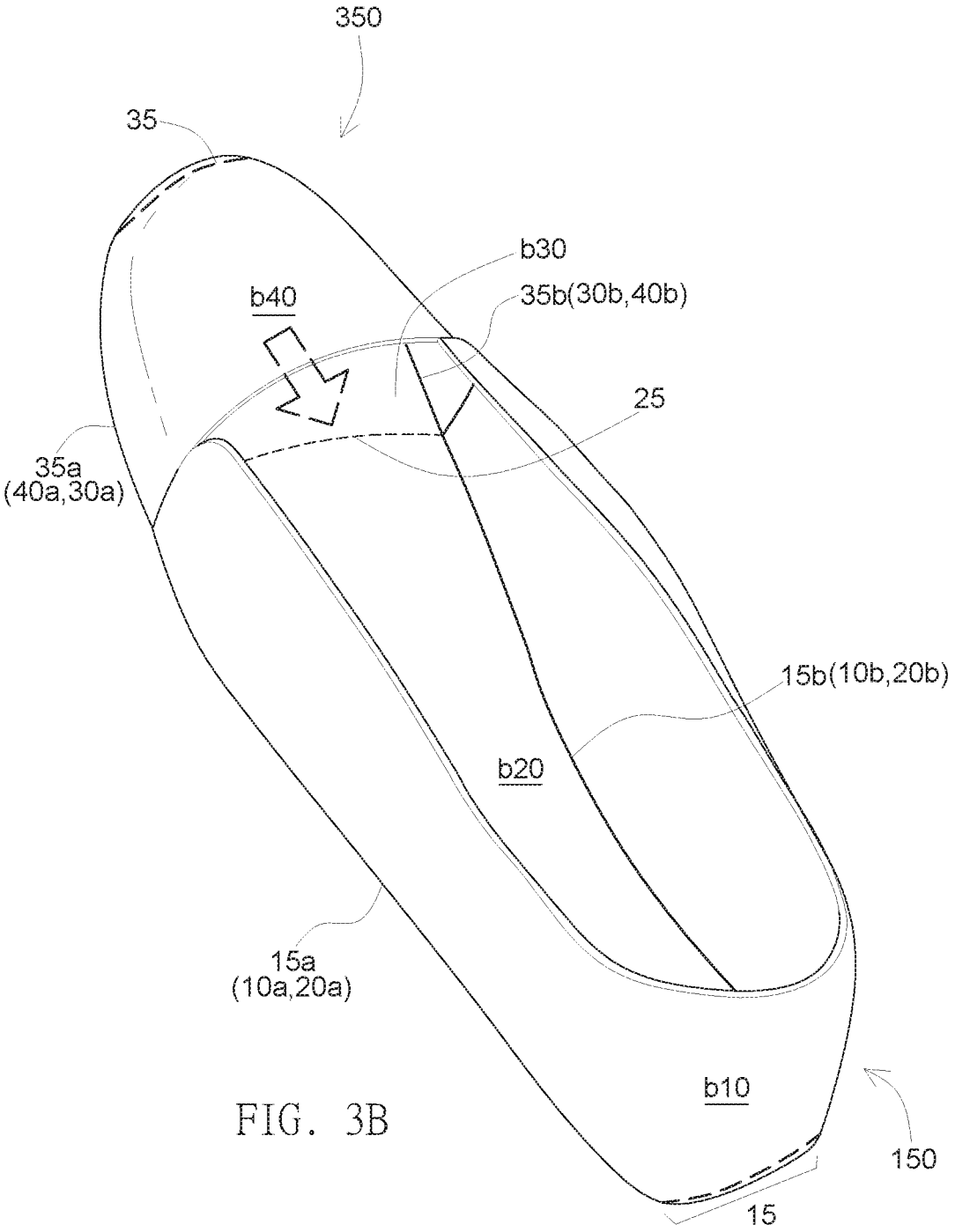

Accordingly, as shown in FIG. 3B in conjunction with FIG. 1 and FIG. 2B, as the toe cap portion b40 is being knitted, the live stitches L40 at the edge of the left and right sides can be sequentially knitted together with the corresponding latitudinal live stitches L30. Therefore, along with the completion of the knitting of the toe cap portion b40, the joining of the toe cap portion b40 and the front sole portion b30 is also completed simultaneously. Consequently, the toe cap portion b40 and the front sole portion b30 can be connected along two knitted lines 35*a* and 35*b* so as to form the three-dimensional front shoe part 350 in a bag shape.

Next, as shown in FIG. 1, after knitting and finishing the three-dimensional front shoe part 350 formed by knitting together the toe cap portion b40 and the front sole portion b30, knitting is continued in the step S50 to form the tongue portion b50 on the front/rear needle bed by extending the toe cap portion b40 from the boundary line 45. Here, the tongue portion b50 may be knitted in a way of repeating the double knitting in a crosswise manner reciprocally from right to left/from left to right on the front needle bed FB and the rear needle bed BB multiple times on the flat knitting machine as stated above. Also, similar to the heel and lateral portion b10 stated above, the number of reciprocating repetitions of the double knitting for the tongue portion b50 can be determined based on the required size to be formed.

The knitting width of the tongue portion b50 can be widened, narrowed, maintained or adjusted as required from the width of the boundary line 45, and the present invention is not limited thereto.

Figure 4:
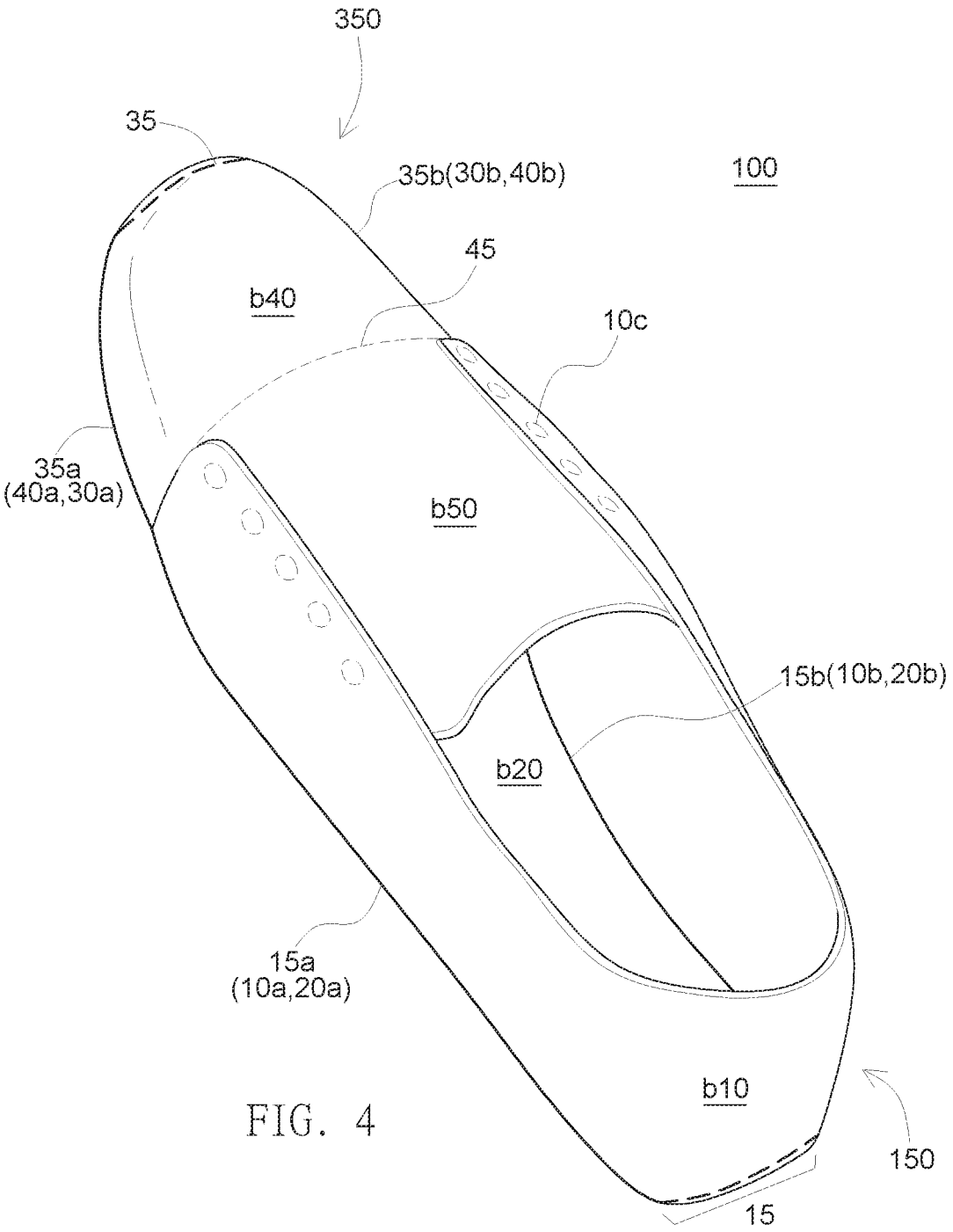
FIG. 4 is a schematic view of a stereoscopic molding of a three-dimensional shoe blank knitted by a manufacturing method according to an embodiment of the present invention.

As shown in FIG. 4, after finishing the knitting of the tongue portion b50, a three-dimensional integrated shoe blank 100 can be formed. Specifically, the three-dimensional shoe blank 100 can be formed as an integrated fabric product, comprising of a heel and lateral portion b10 knitted with at least a yarn and respectively having the first pending selvage edges 10*a* and 10*b* at two sides thereof; a rear sole portion b20 extending from the central part 15 of the heel and lateral portion b10; a front sole portion b30 (not shown in FIG. 4) extending from the rear sole portion b20; the toe cap portion b40 extending from a location of a folding line 35 of the front sole portion b30; and a tongue portion b50 extending from the toe cap portion b40. Among them, the rear sole portion b20 is respectively provided with the first connecting selvage edges 20*a* and 20*b* along the two sides thereof, and in the three-dimensional shoe blank 100, the three-dimensional rear shoe part 150 is formed by knitting together the first connecting selvage edges 20*a* and 20*b* and the first pending selvage edges 10*a* and 10*b* respectively, and two knitted lines 15*a* and 15*b* are provided between the rear sole portion b20 and the heel and lateral portion b10. In addition, the front sole portion b30 (not shown in FIG. 4) is respectively provided with second pending selvage edges 30*a* and 30*b* along the two sides thereof, the toe cap portion b40 is respectively provided with the second connecting selvage edges 40*a* and 40*b* along two sides thereof, and the second connecting selvage edges 40*a* and 40*b* are respectively knitted together with the second pending selvage edges 30*a* and 30*b* so as to connect the front sole portion b30 and the toe cap portion b40 to form a three-dimensional front shoe part 350 in a bag shape accordingly in the three-dimensional shoe blank 100.

As mentioned above, the shoe holes 10*c* may be optionally provided on the three-dimensional shoe blank 100, but the present invention is not limited thereto, and the three-dimensional shoe blank 100 may not comprise the shoe holes 10*c*, or the three-dimensional shoe blank 100 may comprise other structures such as a grid mesh similar to the shoe holes 10*c*.

Hereinafter, a three-dimensional shoe blank and a method for manufacturing the same according to different embodiments of the present invention will be further described.

Figure 5:
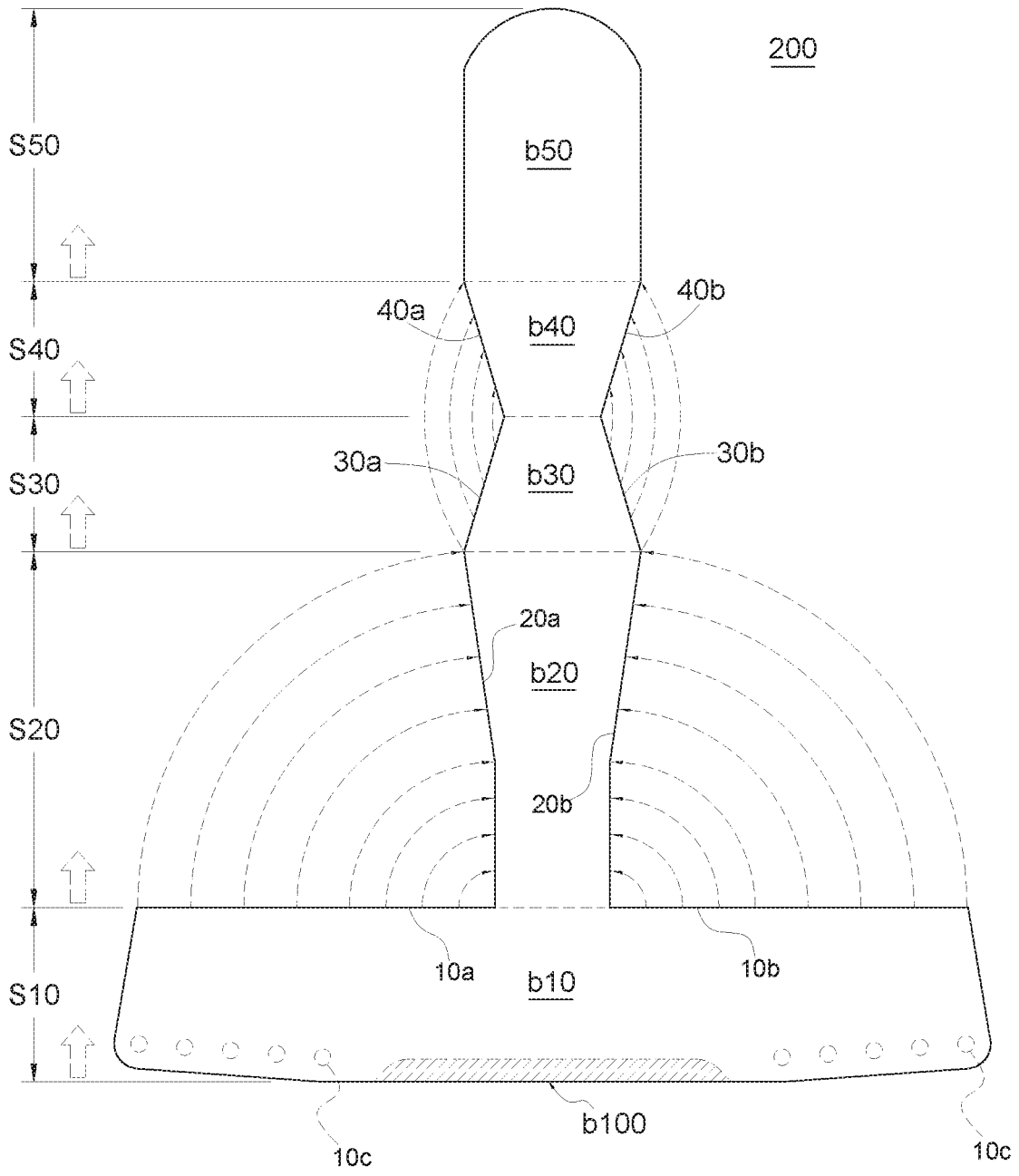
FIG. 5 is a schematic plan view of a three-dimensional shoe blank according to a first modified embodiment of the present invention.

As shown in FIG. 5, based on the first modified embodiment of the present invention, the three-dimensional shoe blank 200 is an integrated fabric product knitted and formed by a flat knitting machine. Specifically, the three-dimensional shoe blank 200 and the method for manufacturing the same are substantially the same as the three-dimensional shoe blank 100 and the method for manufacturing the same as referred above; the only difference is that at least a continuous yarn lining material is embedded to form a topline filling portion b100 with preset thickness between the front and rear needle beds while knitting the front edge of the heel and lateral portion b10. The knitting method of said topline filling portion b100 has been disclosed in the yarn pressing and filling bag-shape knitting method of Taiwan Patent TW M529710, and therefore the description is not repeated herein.

Here, at least a continuous yarn lining material may be a yarn having the same characteristic used in knitting the heel and lateral portion b10, the rear sole portion b20, the front sole portion b30, the toe cap portion b40, and the tongue portion b50 as stated above. However, the present invention is not limited thereto, and the continuous yarn lining material may be a material having different characteristics from the above stated yarn. Further, the aspects of embodiments of the topline filling portion b100 with embedded continuous yarn lining materials in a preset thickness provided in the front edge of the heel and lateral portion b10 can be applied to any embodiments of the three-dimensional shoe blank stated above and below, and the present invention is not limited to the embodiments specifically illustrated here.

Figure 6:
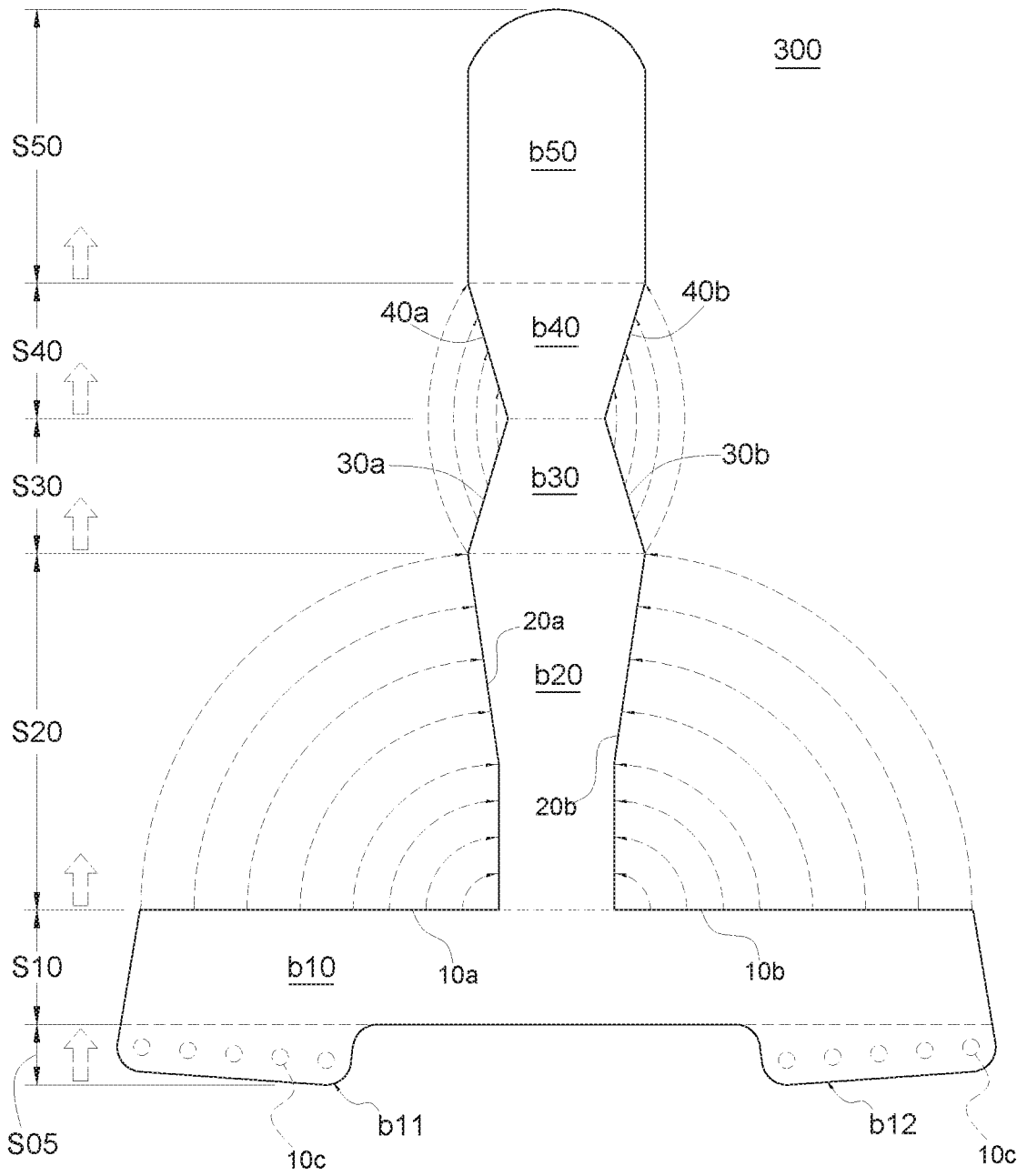
FIG. 6 is a schematic plan view of a three-dimensional shoe blank according to a second modified embodiment of the present invention.
Figure 7:
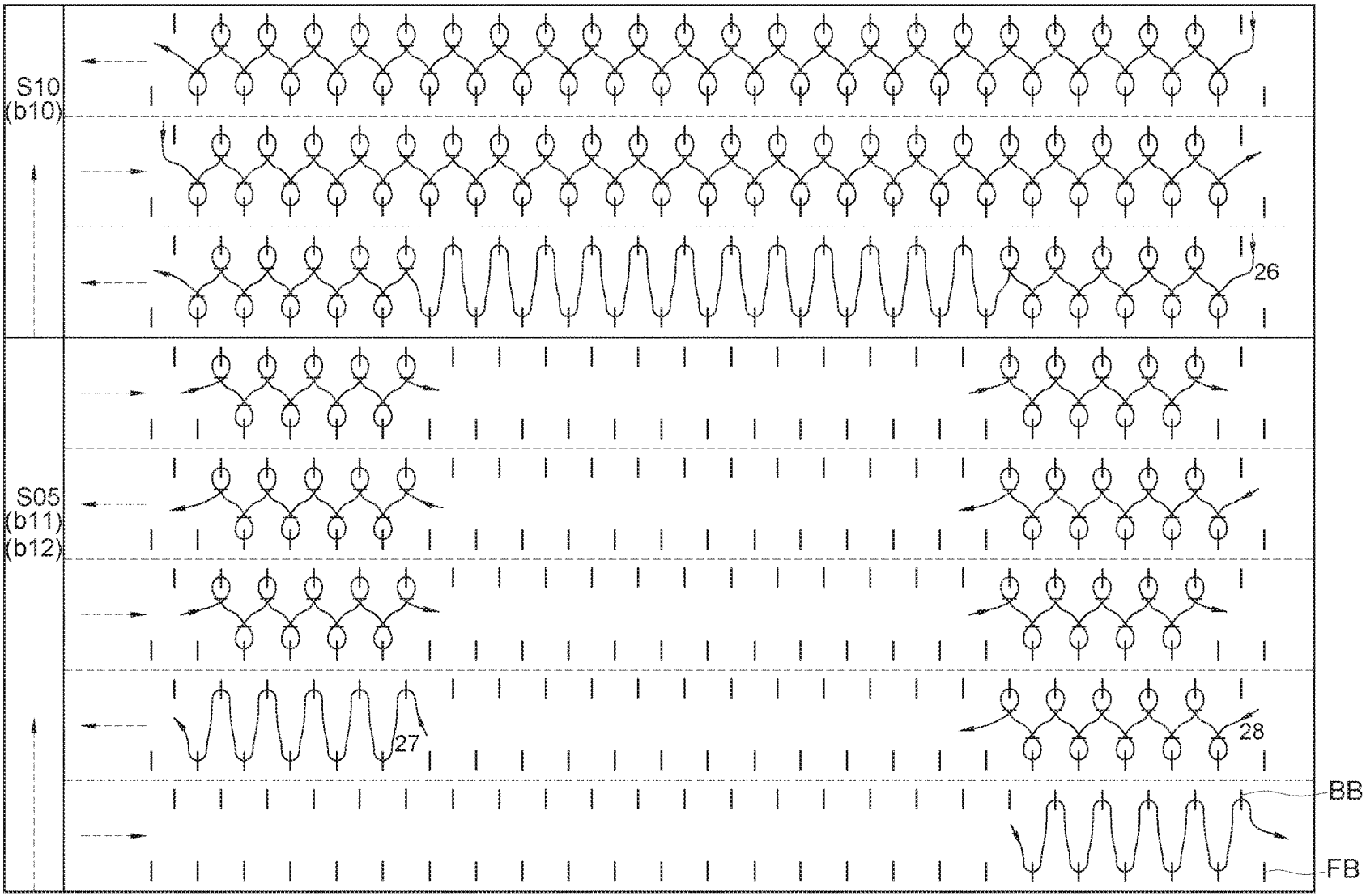
FIG. 7 is a schematic view of a knitting process of a three-dimensional shoe blank according to a second modified embodiment of the present invention.
Figure 8:
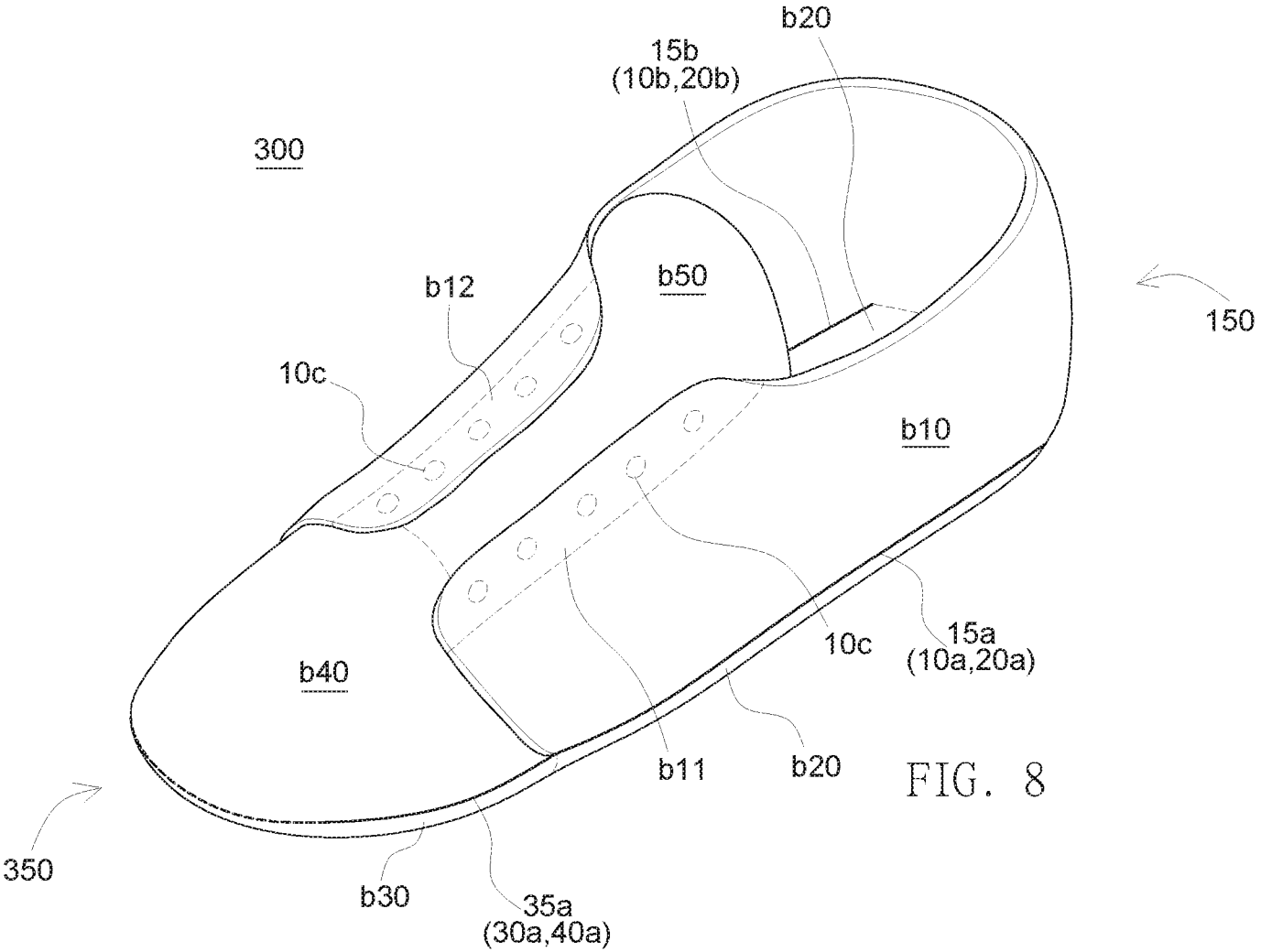
FIG. 8. is a schematic view of a stereoscopic molding of a three-dimensional shoe blank knitted from a manufacturing method according to a second modified embodiment of the present invention.

Next, as shown in FIG. 6 to FIG. 8, a three-dimensional shoe blank 300 and a method for manufacturing the same according to a second modified embodiment of the present invention will be further described hereinafter.

First, as shown in FIG. 6, the three-dimensional shoe blank 300 is an integrated fabric product knitted and formed by a flat knitting machine. Specifically, the three-dimensional shoe blank 300 and the method for manufacturing the same are substantially the same as the three-dimensional shoe blank 100 and the method for manufacturing the same as referred above; the only difference is that a first collar portion b11 and a second collar portion b12 are formed before forming the heel and lateral portion b10. That is, based on the second modified embodiment, the three-dimensional shoe blank 300 further comprises the first collar portion b11 and the second collar portion b12 disposed with respect to the location of the first collar portion b11 along two sides of the heel and lateral portion b10.

Specifically, as shown in FIG. 6 and FIG. 7, a knitting step S05 for forming the first collar portion b11 and the second collar portion b12 is further included before the step S10 for forming the heel and lateral portion b10. As shown in FIG.

6 and FIG. 7, the first collar portion b11 and the second collar portion b12 is preferentially strips knitted and formed of at least a yarn 27 and at least a yarn 28, and after such knitting is completed, the heel and lateral portion b10 is continuously knitted with the yarn 26. Here, the first collar portion b11 and the second collar portion b12 can be preferentially knitted in a way of repeating the double knitting reciprocally in a crosswise manner from right to left/from left to right on the front needle bed FB and the rear needle bed BB multiple times on the flat knitting machine as stated above. Also, similar to the heel and lateral portion b10 stated above, the number of reciprocating repetitions of the double knitting for the first collar portion b11 and the second collar portion b12 can be determined based on the required size to be formed. Thus, the yarn 27 may be provided to knit and form the first collar portion b11 knitted together with the heel and lateral portion b10 on the front/rear needle bed; and another yarn 28 may be provided simultaneously to knit and form the second collar portion b12 which is knitted together with the heel and lateral portion b10 on the front/rear needle bed.

The lengths of the first collar portion b11 and the second collar portion b12 partially protruding from the heel and lateral portion b10 may be the same or different, and the first collar portion b11 and the second collar portion b12 may be knitted with the same or different yarns as required. In one embodiment, the yarns 27 and 28 for the first collar portion b11 and the second collar portion b12 are preferentially the same yarn as yarn 26 above, or may be a different yarn from the yarn 26 above. In another embodiment, the first collar portion b11 and the second collar portion b12 can be double knitted from the yarn 26 above in conjunction with other yarns added.

By forming the first collar portion b11 and the second collar portion b12 first and followed by performing the method mentioned above with reference to FIG. 1 to FIG. 4, the three-dimensional shoe blank 300 shown in FIG. 8 can be formed. As seen in FIG. 8, the first collar portion b11 and the second collar portion b12 may be extended from the three-dimensional rear shoe part 150 to overlap the tongue portion b50. However, this is only an example, and the present invention is not limited thereto.

Furthermore, similar to forming the shoe holes 10*c* on the heel and lateral portion b10 as stated above, in the case that the first collar portion b11 and the second collar portion b12 are further included, one or more shoe holes 10*c* may be formed respectively and simultaneously while knitting the first collar portion b11 and the second collar portion b12. For example, one or more shoe holes 10*c* may be knitted on the two sides of the first collar portion b11 and the second collar portion b12, or one or more shoe holes 10*c* may be punched on both sides with metal rings after the first collar portion b11 and the second collar portion b12 are made, or one or more shoe holes 10*c* may be knitted and formed in a rough shape and then punched with metal rings to further enhance the shape of the shoe holes 10*c*. However, the present invention is not limited thereto, and the one or more shoe holes 10*c* may be formed on the first collar portion b11 and the second collar portion b12 using various known or future developed techniques, and the location formed with the shoe holes 10*c* may be varied based on the design of the shoes. Accordingly, the first collar portion b11 and the second collar portion b12 of the three-dimensional shoe blank 300 are respectively provided with a plurality of shoe holes 10*c*.

Here, besides the above differences, the processes of manufacturing three-dimensional shoe blank 300 which are the same as the processes of manufacturing three-dimensional shoe blank 100 will not be repeated herein.

Figure 9:
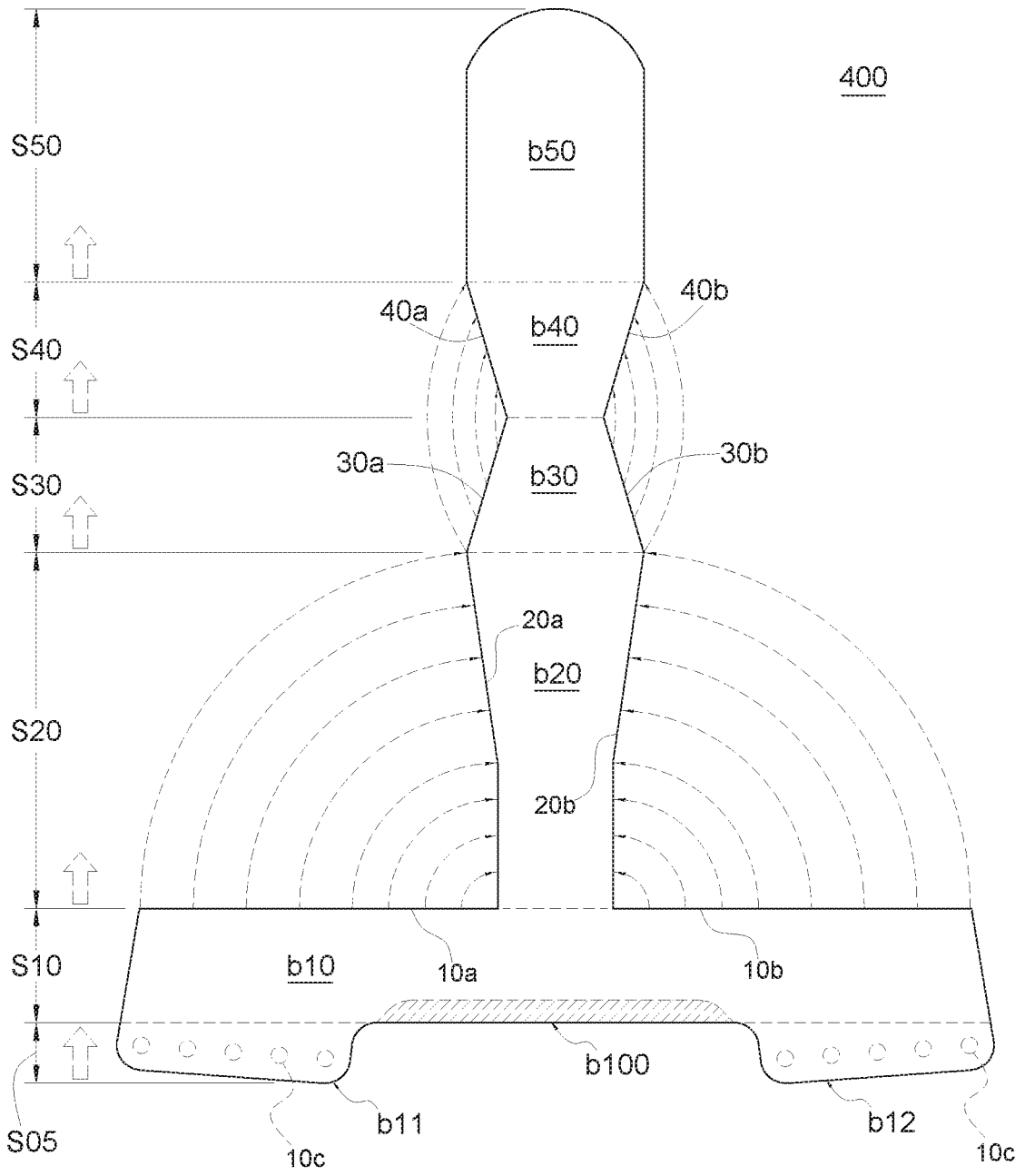
FIG. 9 is a schematic plan view of a three-dimensional shoe blank according to a third modified embodiment of the present invention.
Figure 10:
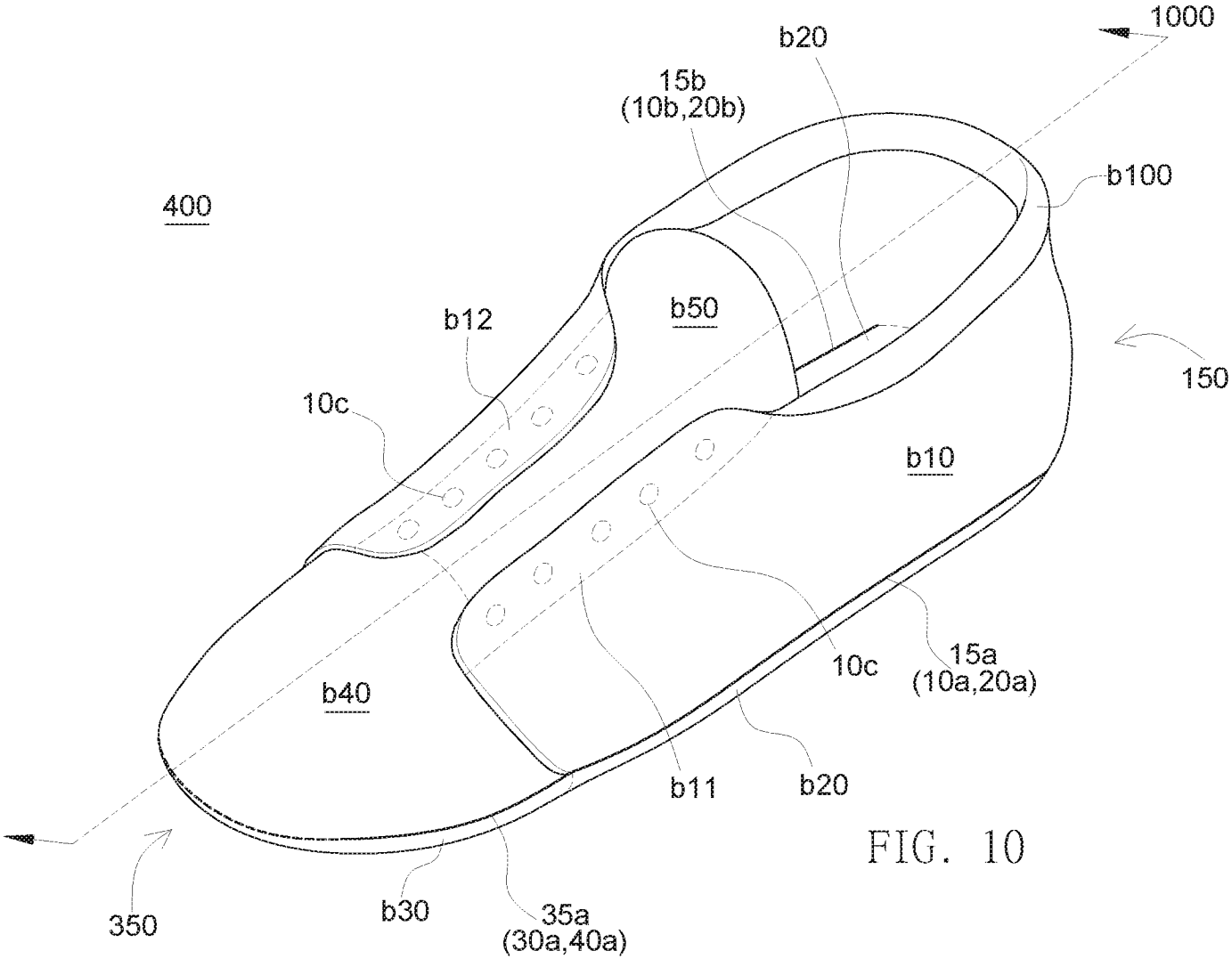
FIG. 10 is a schematic view of a stereoscopic molding of a three-dimensional shoe blank knitted from a manufacturing method according to a third modified embodiment of the present invention.
Figure 11:
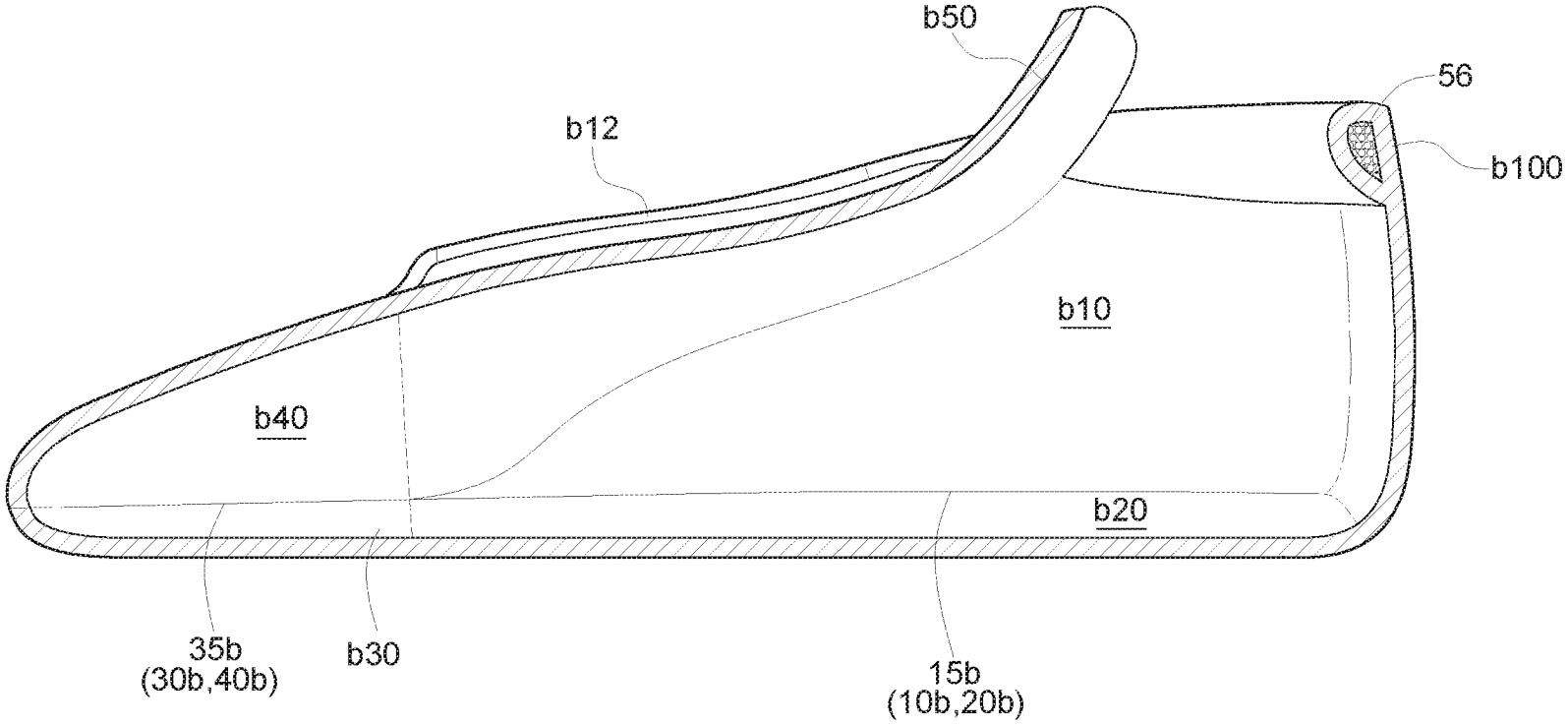
FIG. 11 is a schematic cross-sectional view of the three-dimensional shoe blank of FIG. 10 according to a third modified embodiment of the present invention.

Next, as shown in FIG. 9 to FIG. 11, a three-dimensional shoe blank 400 having the topline filling portion b100, the first collar portion b11, and the second collar portion b12, and a method for manufacturing the same according to a third modified embodiment of the present invention will be further described hereinafter.

First, as shown in FIG. 9, similar to the above embodiments shown with reference to FIG. 6 and FIG. 7, the method for manufacturing the three-dimensional shoe blank 400 comprises the step S05 for forming the first collar portion b11 and the second collar portion b12 first. Then, after forming the first collar portion b11 and the second collar portion b12, the heel and lateral portion b10 is formed in continuation of the first collar portion b11 and the second collar portion b12.

In the step S10 for forming the heel and lateral portion b10, similar to the above knitting methods disclosed in TAIWAN patent TW M529710 with reference to FIG. 5, at least a continuous yarn lining material is embedded to form a topline filling portion b100 with a preset thickness between the front and rear needle beds while knitting the front edge of the heel and lateral portion b10.

In the three-dimensional shoe blank 400 and the method for manufacturing the same shown in FIG. 9 to FIG. 11, except for the first collar portion b11 and the second collar portion b12 which is formed first as shown in the embodiment in FIG. 6 and a topline filling portion b100 which is formed successively by knitting and forming the heel and lateral portion b10 as shown in the embodiment in FIG. 5, other processes and structures are all the same as the embodiment shown in FIG. 1 to FIG. 4 above. Therefore, the same or similar detail as the above embodiment will not be repeated hereby, and only the difference from the above embodiment will be described hereinafter.

As shown in the three-dimensional shoe blank 400 of FIG. 10 knitted with reference to FIG. 9, the three-dimensional shoe blank 400 comprises the first collar portion b11 and the second collar portion b12, and the topline filling portion b100 located at the front edge of the heel and lateral portion b10. Furthermore, as shown in FIG. 11, when the three-dimensional shoe blank 400 is viewed along the direction of the arrow taken by the section line 1000 in FIG. 10, it can be seen that part of the second collar portion b12 overlaps the tongue portion b50, and that the topline filling portion b100 comprises the continuous yarn lining material 56 in order to obtain the desire thickness.

Hereinafter, a three-dimensional shoe blank 500 and a method for manufacturing the same according to a fourth modified embodiment of the present invention will then be described with reference to FIG. 12 and FIG. 13.

Figure 12:
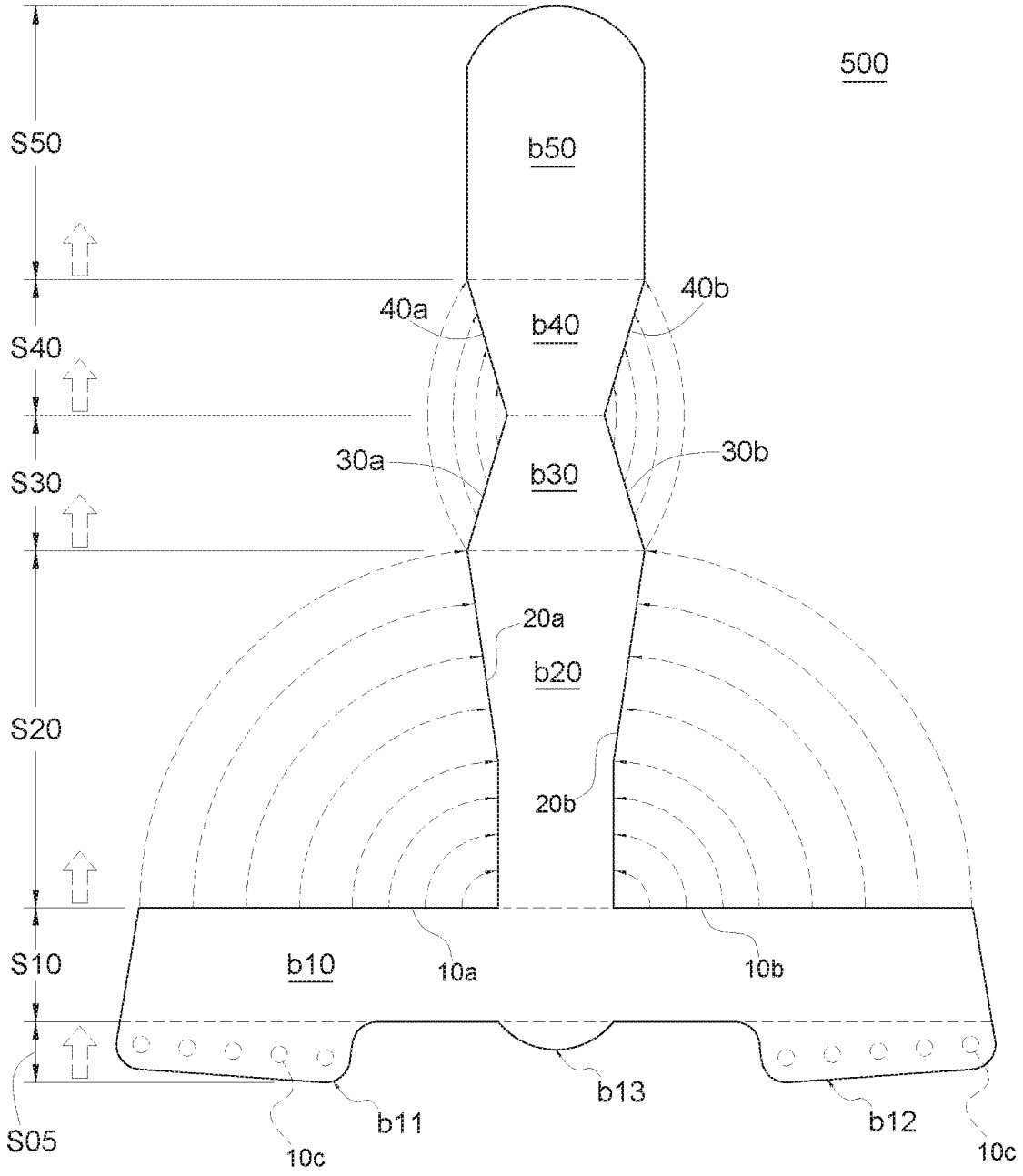
FIG. 12 is a schematic plan view of a three-dimensional shoe blank according to a fourth modified embodiment of the present invention.
Figure 13:
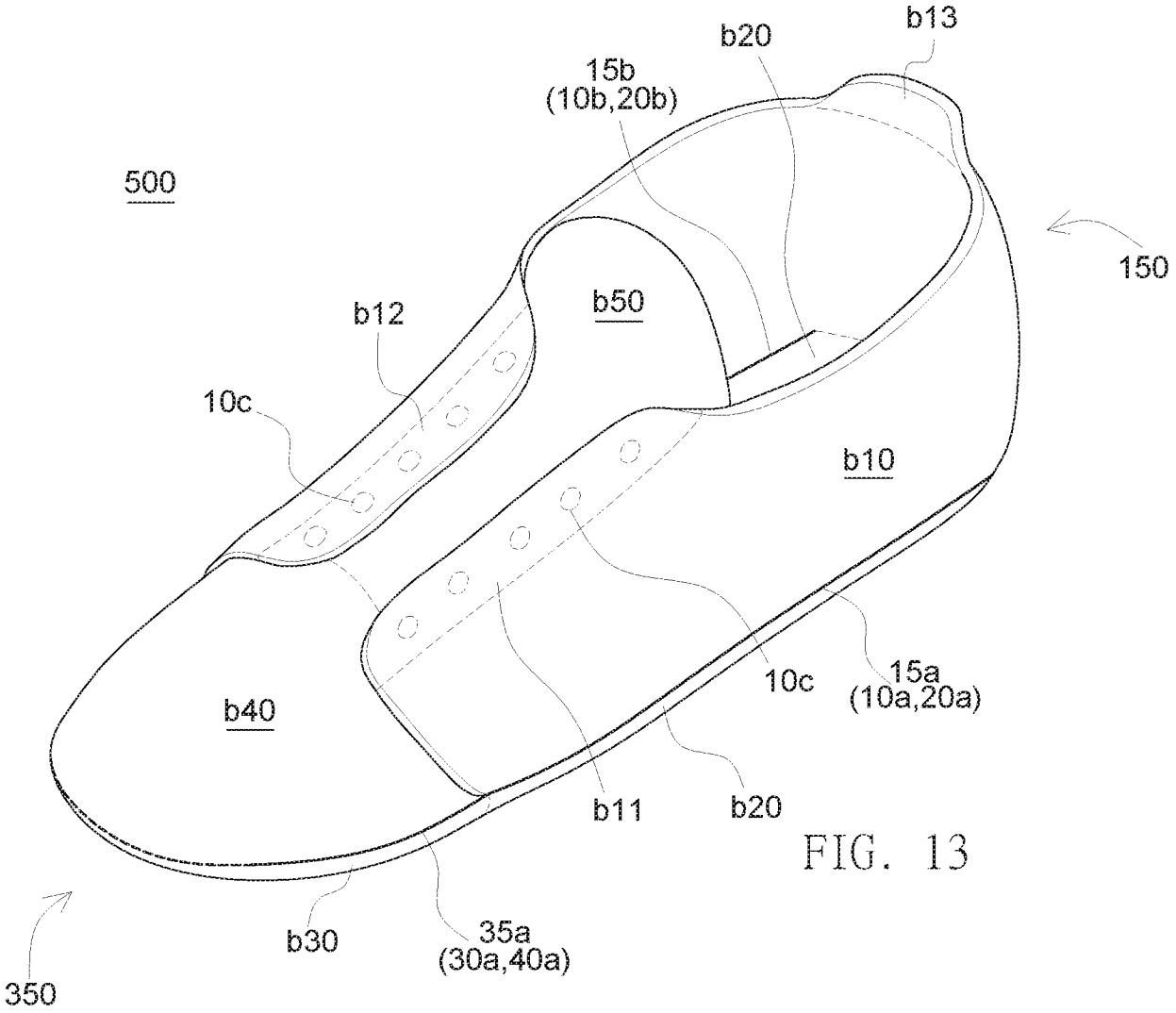
FIG. 13 is a schematic view of a stereoscopic molding of a three-dimensional shoe blank knitted from a manufacturing method according to a fourth modified embodiment of the present invention.

As shown in FIG. 12 and FIG. 13, the three-dimensional shoe blank 500 comprises the first collar portion b11 and the second collar portion b12 as that of the three-dimensional shoe blank 300 shown in FIG. 6; the difference is that the three-dimensional shoe blank 500 further comprises a backstay portion b13 protruding from the heel and lateral portion b10 and knitted together with the heel and lateral portion b10.

The backstay portion b13 may be formed in a similar way of fabricating the first collar portion b11 and the second collar portion b12 as shown with reference to FIG. 6 described above. Specifically, before knitting the heel and lateral portion b10, the step S05 of knitting the first collar portion b11 and the second collar portion b12 further comprises: providing at least a yarn to knit and form the backstay portion b13 protruding from the heel and lateral portion b10 and knitted together with the heel and lateral portion b10 on the front/rear needle bed.

That is, the first collar portion b11, the second collar portion b12 and the backstay portion b13 may be similar extensions knitted from at least a yarn which may be the same or a different yarn, and after such knitting is completed, the knitting in continued to form the heel and lateral portion b10. As a result, the first collar portion b11, the second collar portion b12 and the backstay portion b13 are partially protruding from the heel and lateral portion b10. Thus, the way for knitting and forming the backstay portion b13 is substantially the same as that for the first collar portion b11 and the second collar portion b12, and the location, length and the size of the first collar portion b11, the second collar portion b12 and the backstay portion b13 partially protruding from the heel and lateral portion b10 can be designed as required, and the present invention is not limited thereto.

For example, the backstay portion b13 may be designed to be a semi-circular portion partially protruding from the center of the front edge of the heel and lateral portion b10, disposed between the first collar portion b11 and the second collar portion b12. As shown in FIG. 13, the three-dimensional shoe blank 500 knitted from the above method comprises a semi-circular portion protruding upward from the front edge of the heel and lateral portion b10, so as to help the user put on the shoes by allowing them to grip on to the backstay portion b13 to lift the shoes. However, the shape and the function of the first collar portion b11, the second collar portion b12 and the backstay portion b13 stated here are merely examples, and the present invention is not limited thereto. That is, various shapes of extension portions partially protruding from the heel and lateral portion b10 may be formed if they fall within the scope of the invention, and these extensions may be used to perform various functions.

Next, various aspects of the first collar portion b11 and the second collar portion b12 according to the fifth modified embodiment of the present invention will be described with reference to FIG. 14 and FIG. 15.

Figure 14:
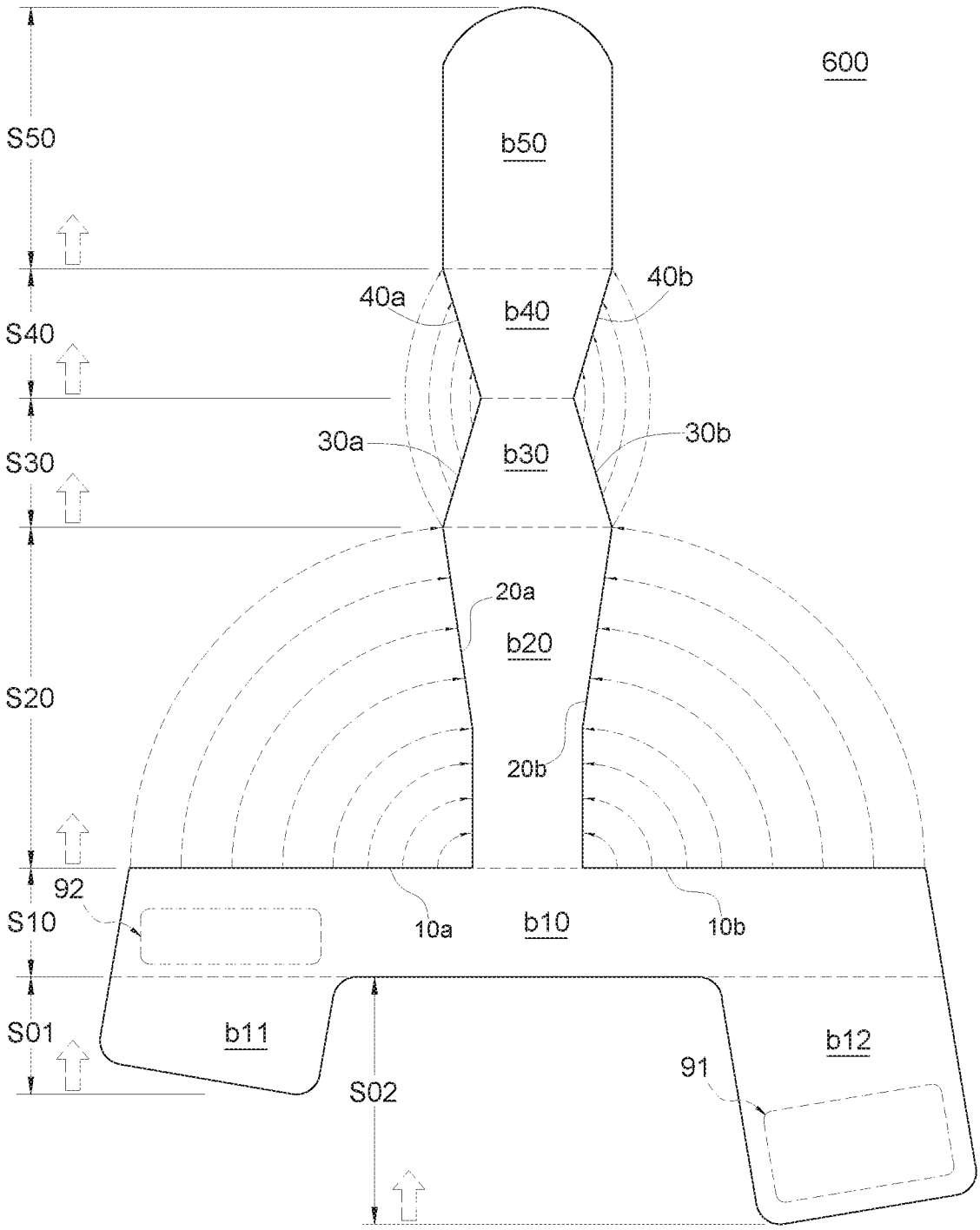
FIG. 14 is a schematic plan view of a three-dimensional shoe blank according to a fifth modified embodiment of the present invention.
Figure 15:
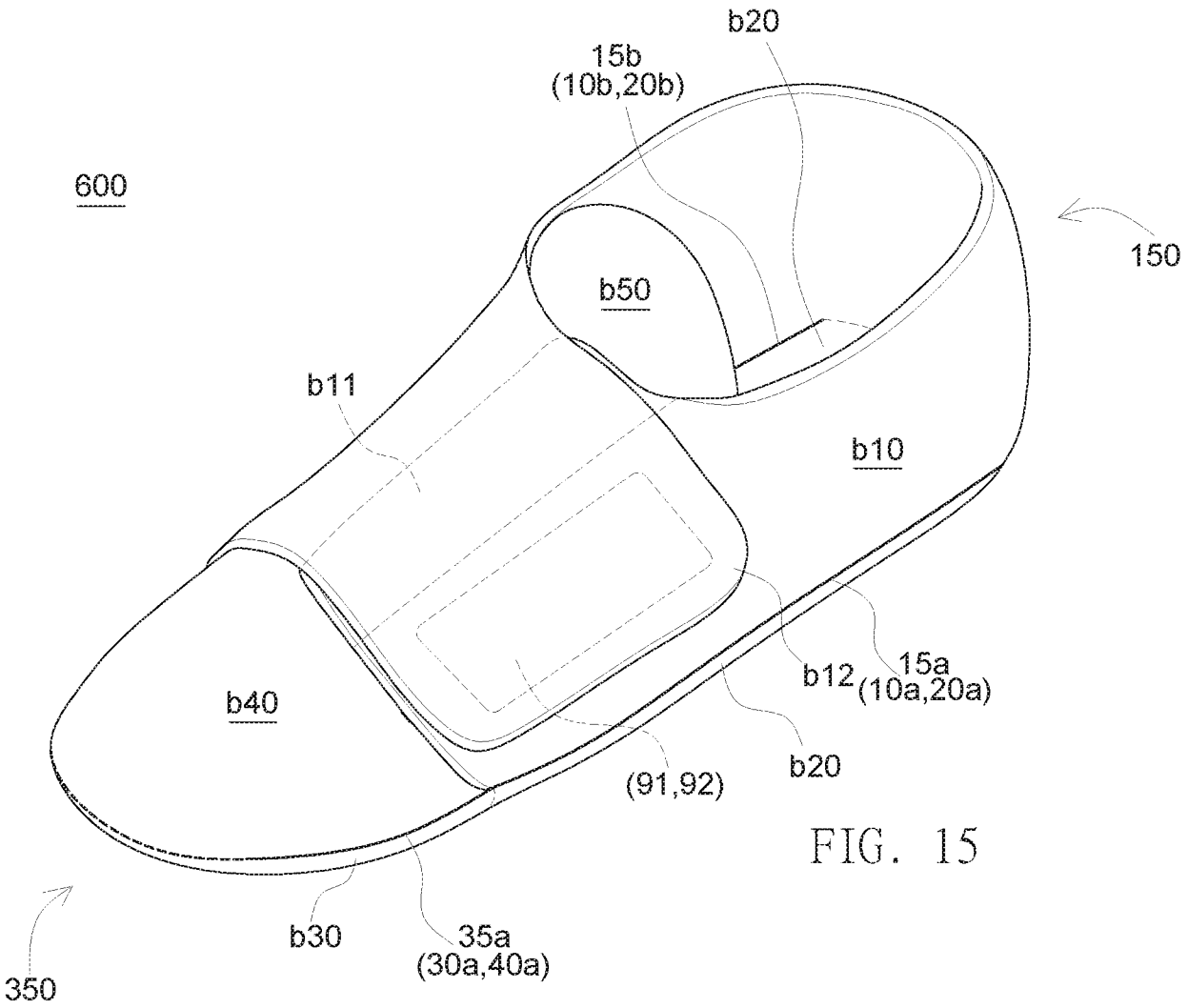
FIG. 15 is a schematic view a stereoscopic molding of a three-dimensional shoe blank knitted from a manufacturing method according to a fifth modified embodiment of the present invention.

As shown in FIG. 14, according to the fifth modified embodiment of the present invention, similar to the embodiment shown with reference to FIG. 6 as stated above, the three-dimensional shoe blank 600 comprises the first collar portion b11 and the second collar portion b12. However, different from the embodiment shown with reference to FIG. 6 as stated above, the first collar portion b11 and the second collar portion b12 of the three-dimensional shoe blank 600 may be knitted and formed respectively through steps S01 and S02, thereby forming the extensions with various lengths and shapes. For example, the second collar portion b12 with longer length may be formed by performing step S02, and the first collar portion b11 with shorter length may be formed by performing the step S01 while knitting the second collar portion b12. That is, the step S01 for forming the first collar portion b11 and the step S02 for forming the second collar portion b12 might be overlapped at least for a period.

Here, apart from the shape and the size, the method for knitting the first collar portion b11 and the second collar portion b12 are substantially the same as the embodiment shown with reference to FIG. 6, and thus the detailed description will not be repeated hereby.

Comparing the three-dimensional shoe blank 600 of the present embodiment with the three-dimensional shoe blank 300 of the embodiment shown with reference to FIG. 6, in addition to the difference in the relative shapes and sizes of the first collar portion b11 and the second collar portion b12, the three-dimensional shoe blank 600 further comprises a connector 91 and an adapter 92.

Specifically, in the three-dimensional shoe blank 600, a connector 91 may be provided on the second collar portion b12 during or after knitting, and an adapter 92 adapted to the connector 91 may be provided on the first collar portion b11 or the heel and lateral portion b10. For example, as shown in FIG. 15, the connector 91 may be provided on the second collar portion b12, and the adapter 92 may be provided on the heel and lateral portion b10 with respect to the side of the first collar portion b11. Accordingly, the connector 91 may be adapted to the adapter 92 when the second collar portion b12 overlaps the first collar portion b11, thereby making the shoes to be put on more easily. However, the present invention is not limited to the aspects shown in FIG. 14 and FIG. 15, and the connector 91 and the adapter 92 may be provided respectively on the first collar portion b11 and the second collar portion b12 or other corresponding positions if they can be adapted and connected with respect to each other.

Here, the connector 91 and the adapter 92 might be corresponding magnet pairs, zippers, straps, hidden buttons, bias tapes, male and female buckle, latch clips, button pairs, clasp, Touch Fastener, Velcro, etc., and any other objects apart from the above examples may be used, provided that the connector 91 and the adapter 92 can be conjugated with respect to each other, and the present invention is not limited thereto.

The above stated "first" and "second" of the first collar portion b11 and the second collar portion b12 are merely illustrated for convenience of description, and the prefixes thereof are interchangeable. That is, although the second collar portion is longer than the first collar portion in the above statement and the connector 91 and the adapter 92 can be provided respectively with respect to the second collar portion and the first collar portion, in the case that the prefixes thereof are interchanged, the description can be stated as the first collar portion is longer than the second collar portion and the connector 91 and the adapter 92 can be provided respectively with respect to the first collar portion and the second collar portion.

The various aspects with reference to FIG. 1 to FIG. 15 as stated above, such as the structures and the shapes of the backstay portion, the first collar portion, the second collar portion and the topline filling portion can be combined with respect to each other and modified into various embodiments without conflict, and thus the description is not repeated here.

Implementing one or more embodiments of the present invention, an integrated shoe blank with a three-dimensional structure can be formed after the knitting is completed. Thus, the making of a three-dimensional shoe blank can be more efficient, and the process and the work for the seaming and assembly can be omitted, therefore lowering the cost and time for manufacturing the shoe blank. Furthermore, the integrity of the three-dimensional shoe blank formed by the above stated method is better, and as a result, the integrity of the appearance of the shoes is improved.

The descriptions stated here are merely some preferred embodiments of the present invention. It should be noted that various changes and modifications can be made to the present invention without departing from the spirit and scope of the present invention. It would be understood for those skill in the art that the present invention is defined as the appended claims, and various changes of possible substitutions, combinations, modifications and diversion complied with the concept of the present invention should all fall within the scope of the invention as defined in the appended claims.

What is claimed is:

1. A method for knitting a three-dimensional shoe blank by a flat knitting machine, comprising:

providing at least a yarn to knit and form a heel and lateral portion (b10), after forming the heel and lateral portion, a plurality of lateral live stitches (L10) are preserved on needle beds at first pending selvage edges (10*a*, 10*b*) along two sides of an end edge of the heel and lateral portion;

continuing knitting and forming a rear sole portion (b20) from a predetermined number of stitches along the center of the end edge of the heel and lateral portion, wherein when the number of stitches reaches a predetermined number on first connecting selvage edges (20*a*, 20*b*) at the two sides of the rear sole portion while knitting the rear sole portion, the flat knitting machine moves transversely from side to side to sequentially knit live stitches (L20) at the edge of the rear sole portion together with the lateral live stitches on the needle bed respectively, so that the heel and lateral portion is combined with the rear sole portion to form a three-dimensional rear shoe part;

continuing knitting and forming a front sole portion (b30) from the rear sole portion, wherein the knitting is gradually narrowed at two sides when knitting the front sole portion, and a plurality of latitudinal live stitches (L30) are preserved on the needle bed at second pending selvage edges (30*a*, 30*b*) along the two sides of the front sole portion;

continuing knitting and forming a toe cap portion (b40) from the front sole portion, and when the knitting of the toe cap portion reaches two sides at second connecting selvage edges (40*a*, 40*b*), sequentially knit live stitches (L40) on the two sides of the toe cap portion together with the latitudinal live stitches on the needle bed respectively to form a three-dimensional front shoe part in a bag shape; and continuing knitting and forming a tongue portion (b50) from the toe cap portion.

2. The method of claim 1, further comprising forming a plurality of shoe holes (10*c*) respectively on both sides of the heel and lateral portion when knitting the heel and lateral portion.

3. The method of claim 2, further comprising:

before knitting the heel and lateral portion, providing at least a yarn to knit and form a backstay portion (b13) protruding from the heel and lateral portion, to be joined to the heel and lateral portion.

4. The method of claim 2, further comprising:

embedding at least a continuous yarn lining material to form a topline filling portion (b100) with a preset thickness while knitting a front edge of the heel and lateral portion.

5. The method of claim 1, further comprising:

providing at least a yarn to knit and form a first collar portion (b11), which is to be joined to the heel and lateral portion by knitting; and providing at least another yarn to simultaneously knit and form a second collar portion (b12), which is to be joined to the heel and lateral portion by knitting, before forming the heel and lateral portion.

6. The method of claim 5, further comprising: simultaneously and respectively forming a plurality of shoe holes (10*c*) while knitting the first collar portion and the second collar portion.

7. The method of claim 6, further comprising:

before knitting the heel and lateral portion, providing at least a yarn to knit and form a backstay portion (b13) protruding from the heel and lateral portion, to be joined to the heel and lateral portion.

8. The method of claim 6, further comprising:

embedding at least a continuous yarn lining material to form a topline filling portion (b100) with a preset thickness while knitting a front edge of the heel and lateral portion.

9. The method of claim 5, further comprising:

before knitting the heel and lateral portion, providing at least a yarn to knit and form a backstay portion (b13) protruding from the heel and lateral portion, to be joined to the heel and lateral portion.

10. The method of claim 5, further comprising:

embedding at least a continuous yarn lining material to form a topline filling portion (b100) with a preset thickness while knitting a front edge of the heel and lateral portion.

11. The method of claim 1, further comprising:

before knitting the heel and lateral portion, providing at least a yarn to knit and form a backstay portion (b13) protruding from the heel and lateral portion, to be joined to the heel and lateral portion.

12. The method of claim 1, further comprising:

embedding at least a continuous yarn lining material to form a topline filling portion (b100) with a preset thickness while knitting a front edge of the heel and lateral portion.

* * * * *